US010293364B2

(12) United States Patent
Cameron

(10) Patent No.: US 10,293,364 B2
(45) Date of Patent: May 21, 2019

(54) STRIPING TOOL

(71) Applicant: CAMERON-CHACE, LLC, Columbia, SC (US)

(72) Inventor: Michael Stuart Cameron, Irmo, SC (US)

( * ) Notice: Subject to any disclaimer, the term of this patent is extended or adjusted under 35 U.S.C. 154(b) by 0 days.

(21) Appl. No.: 15/486,604

(22) Filed: Apr. 13, 2017

(65) Prior Publication Data

US 2017/0297051 A1 Oct. 19, 2017

Related U.S. Application Data

(60) Provisional application No. 62/321,855, filed on Apr. 13, 2016.

(51) Int. Cl.

| | |
|---|---|
| ***B43K 29/00*** | (2006.01) |
| ***B05C 17/03*** | (2006.01) |
| ***B44D 3/22*** | (2006.01) |
| ***B05C 17/02*** | (2006.01) |
| ***B05C 17/035*** | (2006.01) |
| *B05D 5/06* | (2006.01) |
| *B05D 1/28* | (2006.01) |

(52) U.S. Cl.

CPC ..... *B05C 17/0325* (2013.01); *B05C 17/0245* (2013.01); *B05C 17/035* (2013.01); *B44D 3/225* (2013.01); *B05D 1/28* (2013.01); *B05D 5/06* (2013.01)

(58) Field of Classification Search

CPC ..... B05C 17/0325; B44D 3/225

USPC ..... 401/193

See application file for complete search history.

(56) References Cited

U.S. PATENT DOCUMENTS

| | | | | |
|---|---|---|---|---|
| 1,998,710 | A | 4/1935 | Doane | |
| 6,789,974 | B2 * | 9/2004 | Atkinson | B05C 17/0325 401/183 |
| 6,866,716 | B1 * | 3/2005 | Montemurro | B44D 3/16 118/211 |
| 6,953,298 | B2 * | 10/2005 | Healy | B05C 1/08 118/207 |
| 7,293,929 | B1 * | 11/2007 | Atkinson | B05C 17/0325 401/183 |
| 7,427,427 | B1 * | 9/2008 | Montemurro | B44D 3/16 427/256 |

* cited by examiner

*Primary Examiner* — Jennifer C Chiang

(74) *Attorney, Agent, or Firm* — J. Bennett Mullinax, LLC

(57) ABSTRACT

A holder for a paint striping tool as provided than has a plurality of guide pins which allow for engaging a temporary template to allow for the precise painting of single and multiple paint strips.

7 Claims, 3 Drawing Sheets

STRIPING TOOL

RELATED APPLICATIONS

This application claims the benefit of U.S. Provisional Application Ser. No. 62/321,855 filed on Apr. 13, 2016 and which is incorporated herein by reference.

FIELD OF THE INVENTION

This invention is directed towards a striping tool for applying painted pinstriping and similar decorative features to an exterior finish of a car. The invention is more particularly directed to a holder and guide apparatus that facilitates creation of properly aligned painted pinstripes without the tendency of the tool to deviate from the desired path.

BACKGROUND OF THE INVENTION

This invention relates generally to pinstriping tools that are used to apply paint in the form of decorative stripes to an automotive vehicle. In the years, the industry has utilized a Beugler™ tool as set forth in U.S. Pat. No. 1,998,710 and which is incorporated herein by reference.

A Beugler™ type tool requires a significant level of hand-eye coordination and training in order for the operator to consistently form painted lines without undesired curvature or deviation within the painted stripe. As is known and appreciated in the art the Beugler™ type tool includes a reservoir for paint along with a serrated rotary wheel which is used to receive paint from the tool reservoir and applying the paint while the serrated rotary edge is moved along the exterior painted surface of a vehicle.

There is a need in the art to provide for a tool that can be used to apply painted pinstriping that does not necessitate a high learning curve and expertise in order to obtain consistent professional results.

Accordingly, there remains room for improvement and variation within the art.

SUMMARY OF THE INVENTION

It is one aspect of at least one of the present embodiments to provide for a holder for engaging and supporting a paint striping tool.

It is an additional aspect of at least one of the present embodiments to provide for a holder for a paint striping tool in which the holder defines at least a pair of guide pins which are designed to engage a temporary adhesive guide molding on a vehicles exterior surface and thereby maintain the position of the paint striping rotary tool in a uniform distance and path.

It is a further aspect of at least one embodiment of the present invention to provide for a holder for a paint striping tool in which the holder allows for establishing a variable distance between the guide pins of the holder and the dispensing portion of the tool.

It is a further aspect of at least one embodiment of the present invention to provide for a holder for a paint striping tool having a housing defining a receptacle adapted for engaging a rotary wheel paint dispenser; a first guide pin suspended beneath the housing; a second guide pin suspended beneath the housing, the first and second guide pins being in alignment substantially parallel to a longitudinal axis of the receptacle; wherein when the first and second guide pins engage a template guide, the holder can be moved along the guide.

It is a further aspect of at least one embodiment of the present invention to provide for a holder for a paint striping tool wherein the first guide pin further defines a tip that is asymmetric with respect to a body portion of the guide pin.

It is a further aspect of at least one embodiment of the present invention to provide for a holder for a paint striping tool wherein the first guide pin and the asymmetric tip can be rotated about a longitudinal axis.

It is a further aspect of at least one embodiment of the present invention to provide for a holder for a paint striping tool wherein the housing defines a groove having a lever, the lever in communication with a portion of the first guide pin for rotating the guide pin about a longitudinal axis.

It is a further aspect of at least one embodiment of the present invention to provide for a holder for a paint striping tool wherein the housing defined above the guide pins has a height greater than a housing height defined by the receptacle.

It is a further aspect of at least one embodiment of the present invention to provide for a holder for a paint striping tool wherein the housing defines an arcuate taper between the receptacle and the portion of the housing above the guide pins.

It is a further aspect of at least one embodiment of the present invention to provide for a holder for a paint striping tool wherein the tip of the first guide pin and the second guide pin is made of UHWPE.

It is a further aspect of at least one embodiment of the invention to provide for a process of applying paint strips on a surface of a vehicle comprising the steps of: providing a holder, the holder further comprising; a housing defining a receptacle adapted for engaging a rotary wheel paint dispenser; a first guide pin suspended beneath the housing; a second guide pin suspended beneath the housing, the first and second guide pins being substantially parallel to a longitudinal axis of the receptacle; wherein when the first and second guide pins engage a template guide, the holder can be moved along the guide; placing a template on a surface on the vehicle, the template defining a groove for receiving at least one of the first guide pins or second guide pin; placing the holder having a paint dispensing tool therein with at least one of the first or the second guide pins engaging a groove of the template; applying a strip of paint from the dispensing tool to a surface of the vehicle while the holder is moved along the template.

The process described above can include the additional step of rotating the asymmetrical tip of the first guide pin, thereby varying a distance between the guide pin and the applicator wheel of the dispensing tool; applying a second strip of paint, a uniform spaced distance form the first strip, thereby providing a pair of uniformly paint strips.

BRIEF DESCRIPTION OF THE DRAWINGS

A fully enabling disclosure of the present invention, including the best mode thereof to one of ordinary skill in the art, is set forth more particularly in the remainder of the specification, including reference to the accompanying drawings.

DESCRIPTION OF THE PREFERRED EMBODIMENT

Reference will now be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features, and aspects of the present invention are disclosed in the following detailed description. It is to be understood by one of ordinary skill in the art that the present discussion is a description of exemplary embodiments only and is not intended as limiting the broader aspects of the present invention, which broader aspects are embodied in the exemplary constructions.

In describing the various figures herein, the same reference numbers are used throughout to describe the same material, apparatus, or process pathway. To avoid redundancy, detailed descriptions of much of the apparatus once described in relation to a figure is not repeated in the descriptions of subsequent figures, although such apparatus or process is labeled with the same reference numbers.

Figure 1:
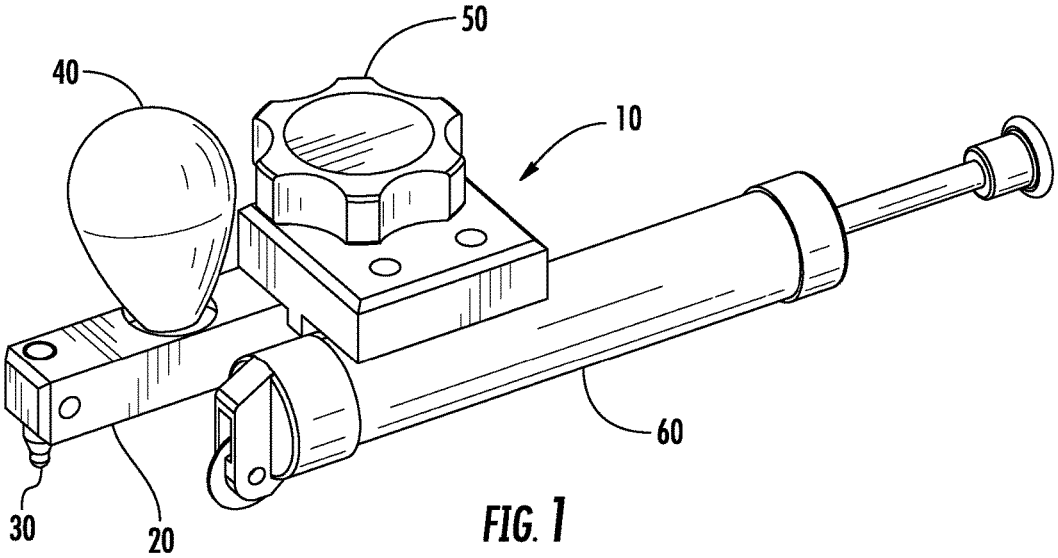
FIG. 1 is a perspective view of a holder in accordance with the present invention in which a Beugler™ type rotary paint dispenser is attached.

As seen in reference to FIG. 1, a holder 10 in provided comprising an arm member 20 that supports a plurality of guide pins 30. The handle 40 is supported on an upper surface of the arm 20. Thumb screw 5 allows for tension of the holder 1 relative to the arm 20 such that the holder 10 can be positioned laterally with respect to arm 20 so as to provide for a greater space between the dispensing tool 60.

As best seen in reference to FIG. 1, the dispensing tool 60 defines an interior reservoir for holding paint. A terminal end of the dispensing tool provides a rotary blade which has slight serrations in the curved surface. The serrations allow paint to be received by the rotary blade and as the wheel rotates against a painted finish of a vehicle, paint is delivered to the surface and creates a pin stripe. As known and appreciated in the art, variations in the width of a blade can be provided to allow variation in the width of a pinstripe.

The dispensing tool 60 is engaged by a lower surface of holder 10 and is maintained at a fixed and variable distance from arm 20. Arm 20 and dispensing tool 60 are substantially parallel to each other and can be secured using screws to secure holder 10 to the application tool 60. However, other conventional attachment mechanisms could be used including a clamp or a support frame or cradle.

Figure 2:
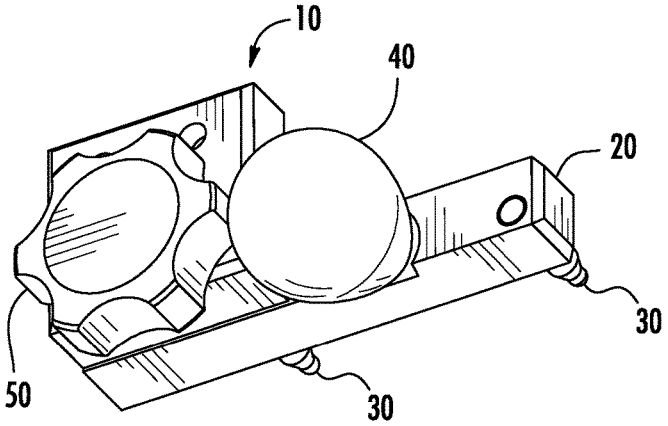
FIGS. 2 and 3 are perspective views showing details of the holder with the dispensing tool removed.
Figure 3:
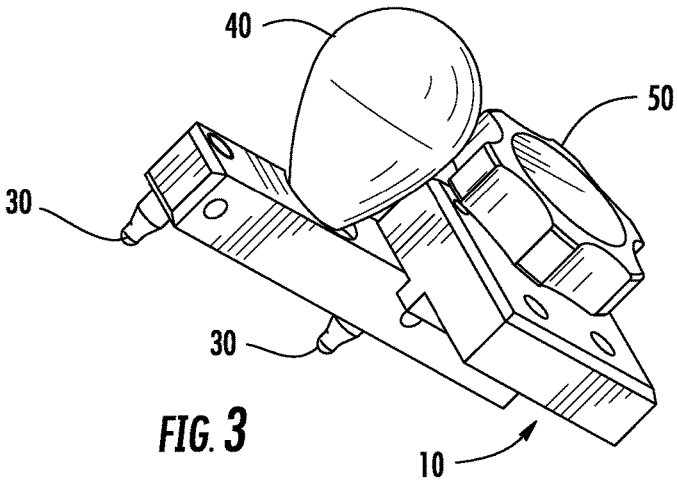

As best seen in reference to FIGS. 2 and 3, the guide pins 30 are attached to an undersurface of arm 20. The guide pins 30 are adapted for engaging a piece of a temporary magnetic molding present on a surface of a vehicle such as a car door. The guide pins 30 are used to hold the apparatus in a desired position and distance with respect to a temporary magnetic molding that defines a groove. As the apparatus and dispensing end of tool 60 engages the painted surface of a car door, the tool moves within in the groove and in a smooth and uniform manner which maintains a desired spaced distance from the guide molding. The guide pins facilitate the alignment of the paint dispensing tool within the groove of the magnetic molding such that a constant distance of the applied pin strip is maintained relative to the guide molding. As a result, a pin stripe applied that is maintained as a smooth, continuous, and uniform distance and shape relative to the guide molding.

The thumb screw 50 allows the holder portion 10 to be set at a greater or lesser distance from the arm 20. In turn, this varies the distance of the paint applicator tool portion 60 from the arm 20. The ability to change the relative distance of the guide pins 30 allows for multiple parallel strips to be provided without movement of the temporary molding template.

Use of the apparatus allows for the secure engagement of a rotary pinstriping tool. The guide pins 30 may be painted from a variety of materials including UHDPE, nylon, stainless steel or similar hand materials with a low coefficient of friction facilitate the smooth application of a pin stripe which is maintained in a spaced, uniformed distance relative to a guide molding template. Since the apparatus can be adjusted with respect to the pinstriping tool, it is possible to apply separate and parallel pin strips with much greater accuracy and uniformity. Heretofore, the provision of single or multiple pin stripes was highly variable depending upon the skill of the operator. The inclusion multiple guide pins on a holder assembly allow for a reliable apparatus that can consistently be used to apply pin stripes which are maintained at fixed distances and with a high level of consistency.

Figure 4:
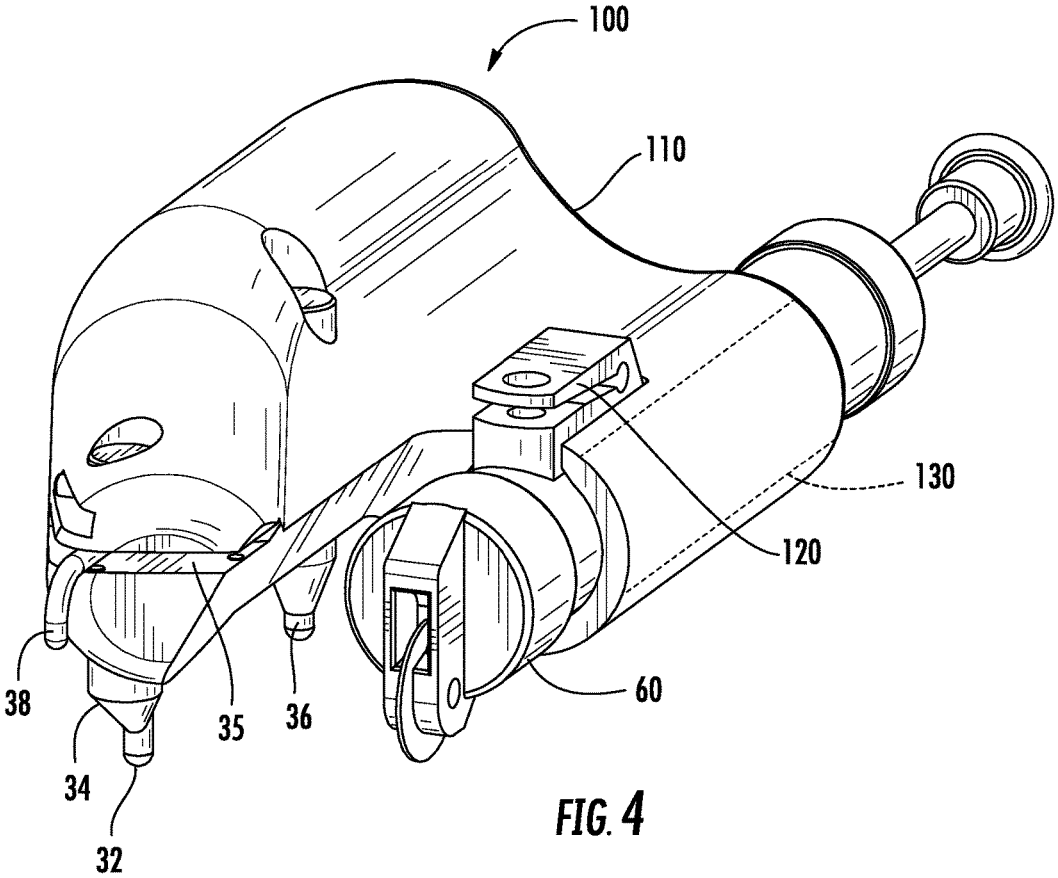
FIGS. 4 and 5 are perspective views of an alternative embodiment of a holder with the dispensing tool attached.
Figure 5:
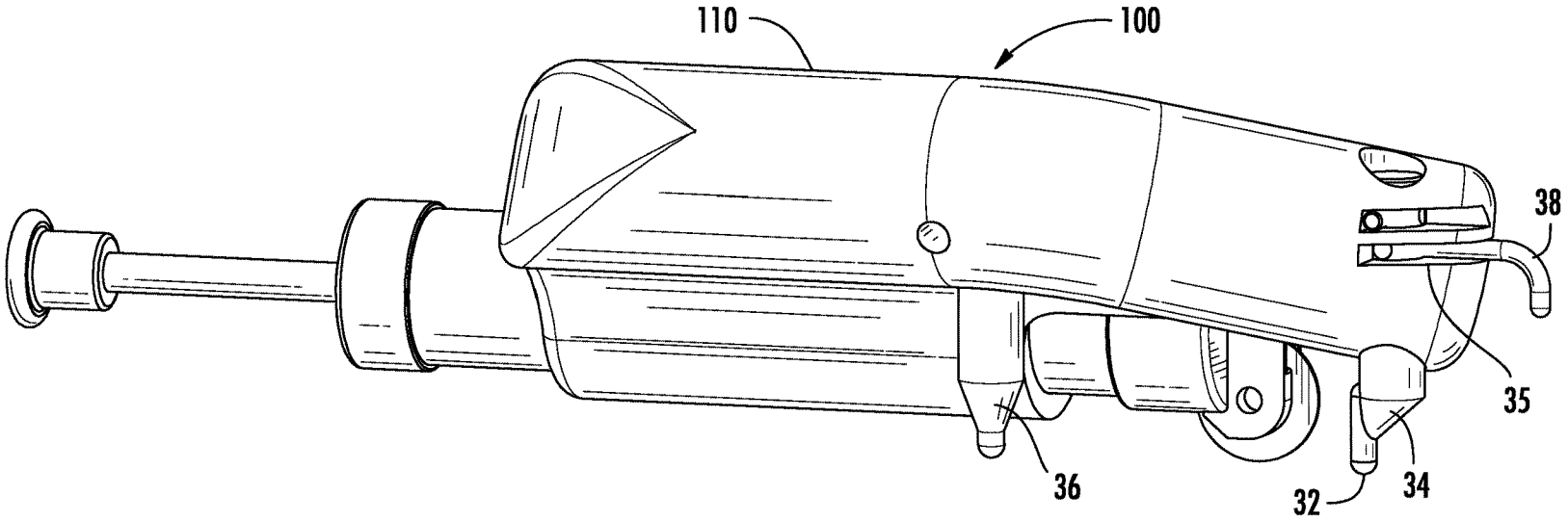

FIGS. 4 and 5 set forth an alternative embodiment of the stripping tool 100. Stripping tool 100 defines a housing 110, housing 110 further defining an opening defined between two parallel lips 130. Lips 130 indicate the location of an optional opening there between that could allow for the insertion of the dispensing tool 60 within the housing. Housing 110 can also be fabricated to allow spacing for any securing clips, fasteners 120, or other hardware that might be present on the dispensing tool 60 in order to allow for a customized fit.

As seen in FIGS. 4 and 5, guide pins 34 and 36 are positioned beneath the housing and with the pins longitudinal axis perpendicular to the housing bottom. Guide pin 34 has an asymmetric tip 32, pin 34 and tip 32 being rotatable by movement of lever 38. Movement of lever 38 rotates guide pin 34. Lever 38 can travel within the dimensions of groove 35 defined by the housing. Detents can be provided within groove 35 that will secure the tip in the desired location.

The asymmetrical tip 32 and rotational pin 34 allows for minor spacing changes to be made with respect to the travel path of the dispensing tool 60 and holder 100. This arrangement facilitates the ability to provide two or more sequentially applied pin strips having a small gap there between. The ability to change the relative dimensions of the assembly tip 32 allows for multiple parallel strips to be provided without movement of the temporary molding template.

Although preferred embodiments of the invention have been described using specific terms, devices, and methods, such description is for illustrative purposes only. The words used are words of description rather than of limitation. It is to be understood that changes and variations may be made by those of ordinary skill in the art without, departing from the spirit or the scope of the present invention as set forth herein. In addition, it should be understood that aspects of the various embodiments may be interchanged, both in whole, or in part. Therefore, the spirit and scope of the invention should not be limited to the description of the preferred versions contained therein.

That which is claimed:

1. A holder for a paint striping tool comprising:

a housing defining a receptacle adapted for engaging a rotary wheel paint dispenser;

a first guide pin suspended beneath the housing; and a second guide pin suspended beneath the housing, the first and second guide pins being in alignment substantially parallel to a longitudinal axis of the receptacle.

2. The holder according to claim 1 wherein the first guide pin further defines a tip that is asymmetric with respect to a body portion of the guide pin.

3. The holder according to claim 2 wherein the first guide pin and the asymmetric tip can be rotated about a longitudinal axis.

4. The holder according to claim 2 wherein the housing defines a groove having a lever, the lever in communication with a portion of the first guide pin for rotating the guide pin about a longitudinal axis.

5. The holder according to claim 1 wherein the housing defined above the guide pins has a height greater than a housing height defined by the receptacle.

6. The holder according to claim 5 wherein the housing defines an arcuate taper between the receptacle and the portion of the housing above the guide pins.

7. The holder according to claim 1 wherein the tip of the first guide pin and the second guide pin is made of UHWPE.

* * * * *